US010220918B2

(12) United States Patent
Knapp et al.

(10) Patent No.: US 10,220,918 B2
(45) Date of Patent: Mar. 5, 2019

(54) HELICAL ANCHOR AND PILING SYSTEM

(71) Applicants: Timothy H. Knapp, Silverdale, WA (US); Lee B. Knapp, Silverdale, WA (US)

(72) Inventors: Timothy H. Knapp, Silverdale, WA (US); Lee B. Knapp, Silverdale, WA (US)

( * ) Notice: Subject to any disclaimer, the term of this patent is extended or adjusted under 35 U.S.C. 154(b) by 0 days.

(21) Appl. No.: 15/976,063

(22) Filed: May 10, 2018

(65) Prior Publication Data

US 2018/0339750 A1 Nov. 29, 2018

Related U.S. Application Data

(60) Provisional application No. 62/509,931, filed on May 23, 2017.

(51) Int. Cl.

| | |
|---|---|
| ***E02D 5/56*** | (2006.01) |
| ***E02D 7/22*** | (2006.01) |
| ***B63B 22/04*** | (2006.01) |
| ***E02D 27/42*** | (2006.01) |
| *B63B 21/50* | (2006.01) |

(52) U.S. Cl.

CPC ..... *B63B 22/04* (2013.01); *E02D 5/56* (2013.01); *E02D 27/42* (2013.01); *B63B 2021/505* (2013.01); *E02D 2250/0038* (2013.01)

(58) Field of Classification Search

CPC .... E02D 5/40; E02D 5/41; E02D 5/42; E02D 5/43; E02D 5/44; E02D 5/80; E02D 27/50; E02D 5/22; E02D 5/30; E02D 5/385; E02D 5/54; E02D 7/02; E02D 13/04; E02D 27/525; E02D 2250/0038; B63B 21/24; B63B 21/26; B63B 21/50; E02B 17/02; E02B 17/027; E21B 41/08; E21D 21/00

USPC ..... 405/229–257, 258.1–259.6, 302.4

See application file for complete search history.

(56) References Cited

U.S. PATENT DOCUMENTS 6,058,662 A * 5/2000 Perko ..... E02D 5/801 405/232
6,128,867 A * 10/2000 MacKarvich ..... E02D 5/801 52/155
6,722,821 B1 * 4/2004 Perko ..... E02D 5/801 405/249

(Continued)

*Primary Examiner* — Benjamin F Fiorello
*Assistant Examiner* — Edwin J Toledo-Duran
(74) *Attorney, Agent, or Firm* — Dean A. Craine; Marisa C. Whitaker

(57) ABSTRACT

A ground anchor with an upper helical member attached to or near the upper end of an elongated rod and at least lower helical member attached to the elongated rod below the upper helical member. The upper helical member includes a fixed, spiral-shaped, curved flange. Near or on the outer edge of the curved flange is a continuous or intermittent vertical wall. The lower helical member includes a curved flange similar to the curved flange used on upper helical member. The upper neck of the elongated rod engages a torque generating tool that rotates the anchor into the subsea floor until the helical members are embedded in the subsea floor. A swivel arm attaches to the neck that connects to a line that extends downward to a floating buoy or dock. A piling may be longitudinally aligned over the neck and threaded connectors securely attach the piling to the anchor.

15 Claims, 4 Drawing Sheets

(56) References Cited

U.S. PATENT DOCUMENTS

| | | | | |
|---|---|---|---|---|
| 7,004,683 | B1 * | 2/2006 | Rupiper | E02D 5/56 405/229 |
| 7,736,095 | B2 * | 6/2010 | Fujita | E02D 5/805 269/8 |
| 7,883,295 | B2 * | 2/2011 | Schellhorn | E02D 3/126 405/233 |
| 8,845,236 | B1 * | 9/2014 | Dosdourian | E02D 5/801 175/19 |
| 2009/0257829 | A1 * | 10/2009 | Schellhorn | E02D 3/126 405/267 |
| 2015/0063910 | A1 * | 3/2015 | Meltsov | F03B 13/1815 405/21 |
| 2015/0345098 | A1 * | 12/2015 | Song | E02D 7/22 405/252.1 |
| 2016/0362863 | A1 * | 12/2016 | Oliver | E02D 5/801 |
| 2017/0159256 | A1 * | 6/2017 | Li | E02D 5/526 |

* cited by examiner

HELICAL ANCHOR AND PILING SYSTEM

This utility patent application is based on and claims the filing date benefit of U.S. provisional patent application (application No. 62/509,931) filed on May 23, 2017.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to ground anchors for preventing movement of floating objects or for anchoring posts, poles, or piles upright on a ground surface, and to piling systems that incorporate a ground anchor.

2. Description of the Related Art

Helical, or screw type anchors are commonly embedded into the unconsolidated ground (i.e. underwater ground that is not bedrock or hard pan) to restrain a floating buoy or a floating dock, or to support a piling. One drawback with using helical anchors found in prior art is that they gradually become loose and do not stay embedded in the ground. Eventually, they disengage from the ground and must be replaced.

One reason helical anchors become loose or eventually disengage from the ground is because they are continuously exposed to back and forth lateral forces caused by waves and the wind. The anchor's helical flanges used with helical anchors in the prior art do not provide enough resistance to these lateral forces. Eventually, the ground around the flanges gives way which allows the anchor to move from side to side and eventually disengage from the ground.

While installing larger helical anchors at greater depths into the unconsolidated ground may overcome these drawbacks, the cost of the larger helical anchors and the cost of installation are prohibited for most users.

What is needed is an improved helical anchor that costs approximately the same and uses the same installation methods as a standard helical anchor in the prior art that can withstand laterally forces enabling the anchor to remain engaged to the unconsolidated ground.

SUMMARY OF THE INVENTION

An improved unconsolidated ground anchor to be a restraining device for buoys, floating docks or a piling.

The anchor includes an elongated rod with an upper helical member attached to the elongated rod's upper end and at least one lower helical member spaced apart from the upper helical member and attached near the elongated rod's opposite end. A section of the elongated rod extends upward from the upper helical member and forms a neck that engages a torque generating tool used to rotate and screw the anchor into the ground. When the anchor is properly embedded into the ground, the neck extends upward from the unconsolidated ground and exposed.

In one embodiment, a rotating joint is formed on the neck that attaches to a rigid swivel arm. The end of a line is attached to the swivel arm and extends upward and attaches at an opposite end to a floating buoy or dock. In another embodiment, one or more couplers are formed on the neck configured to slide into the end of a hollow piling. When inserted into the end of the piling, threaded connectors are used attach the neck to the pilling.

The upper helical member includes a fixed, lateral spiral-shaped, curved flange that extends outward from the elongated rod. In one embodiment, the curved flange continues in a 360 arc and is approximately 6 to 36 inches in diameter. It should be understood that the curved flange may follow an arc less or over 360 degrees.

Attached or formed near or on the outer edge of the flange is a short vertical wall. The vertical wall may be a continuous structure that winds around and follows the entire outer edge of the curved flange. The transverse axis of the vertical wall is substantially parallel to the longitudinal axis of the elongated rod. In should be understood that the vertical wall may be broken into a plurality shorter vertical wall sections spaced apart along the outer edge of the curved flange.

In the embodiments shown, the anchor may include at least one lower helical member attached to the elongated rod. The lower helical member like the upper helical member includes a curved flange. The curved flange may include a continuous or intermittent vertical wall.

In one embodiment, the upper and lower helical members are spaced apart at least 18 inches apart so the soil between them is continuous.

DESCRIPTION OF THE PREFERRED EMBODIMENT(S)

Figure 1:
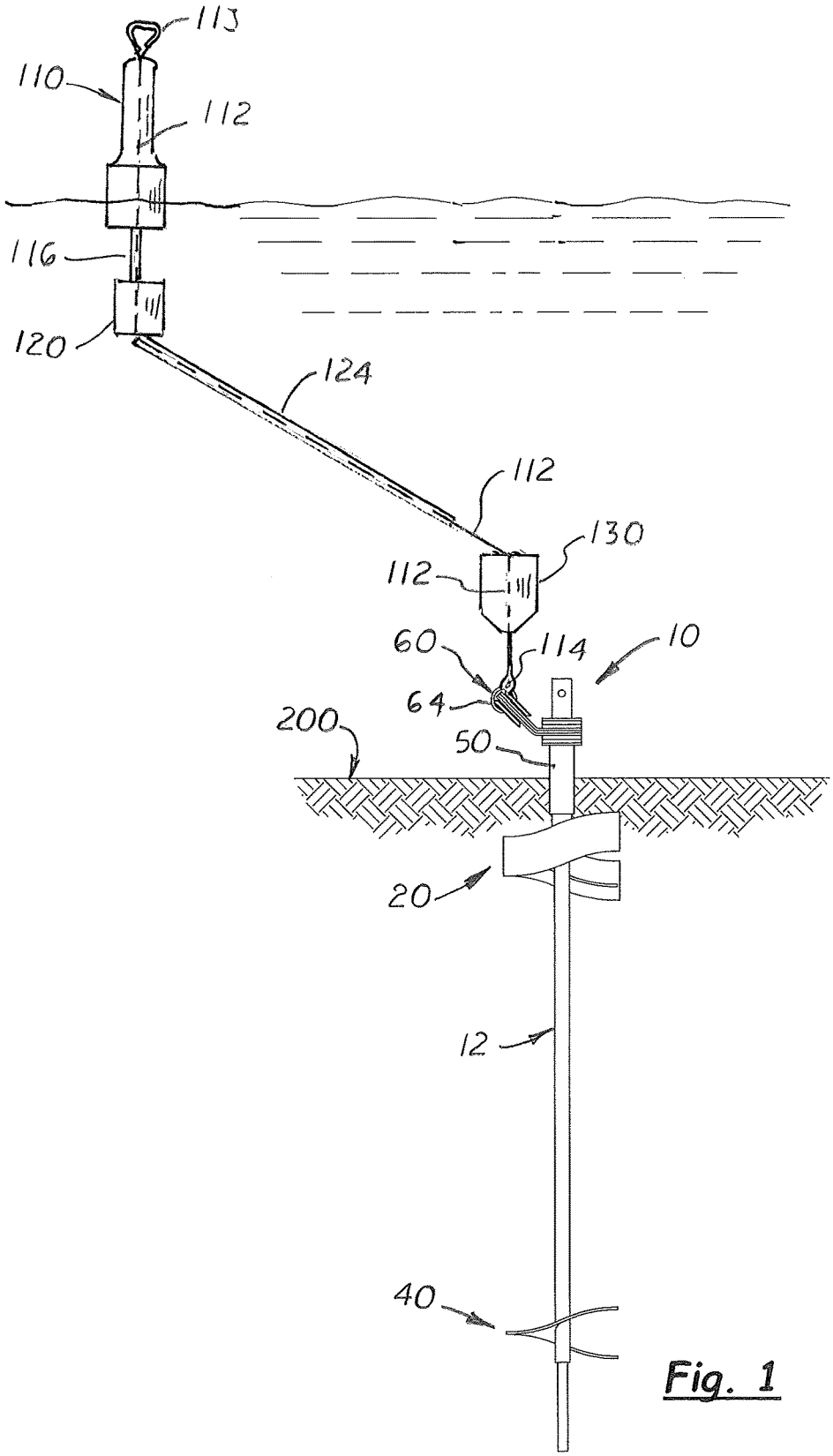
FIG. 1 illustrates the improved ground anchor used to restrain a floating buoy.

Referring to the FIGS. 1-8, there is shown two embodiments of a ground anchor, denoted 10 and 10' used to restrain floating buoys or docks or used to securely connect the end of a piling to the subsea floor 200. In both embodiments, the anchor 10, 10' includes an elongated rod 12 with at an upper helical member 20 attached to the elongated rod's upper end 14. The anchor 10, 10' may include at least one lower helical member 40 securely attached to the elongated rod 12 and located below and spaced apart from the upper helical member 20. The upper end 14 of the elongated rod 12 forms a neck 50 keyed in cross-section, (i.e. square, rectangular, or star-shaped) that extends upward from the upper helical member 20 and selectively engages a torque generating tool (not shown) used to selectively rotate the elongated rod 12 and screw the anchor 10, 10' into the unconsolidated subsea floor 200 until the upper helical member 20 is embedded in the subsea floor 200. In the preferred embodiment, the elongated rod 12 is made of galvanized steel and the neck 50 is made of the same material or made of aluminum and acts as an anode to resist electrolysis in salt water.

In one embodiment, the anchor 10 includes a rotating joint that includes a swivel arm 62 that may be attached to a line 112 attached at one end to a floating buoy 110 or dock (not shown). In another embodiment, the anchor 10' may include one or two couplers 56, 58 that fit inside the hollow end of a piling 90. A set of bores 59, 94 are formed on the couplers 56, 58 that connected to threaded connectors 96 that attach the neck 50 to the piling 90.

As shown in the Figs, the upper helical member 20 includes a fixed, lateral spiral-shaped, curved flange 22 that extends outward from the elongated rod 12. In one embodiment, the curved flange 22 is spiral or helix shaped that curves in a 360 degree arc around the longitudinal axis 13 of the elongated rod 12. In the embodiment shown in the Figs. the outer edge of the curved flange 22 is approximately 12 inches in diameter. The distance between the upper points of the curved flange 22 to the lower points of the curved flange 22 is approximately 6 inches. It should be understood that the curved flange 22 may follow an arc less or over 360 degrees. The diameter of curved flange 22 may be increased or decreased to give greater or less unconsolidated ground support.

Figure 2:
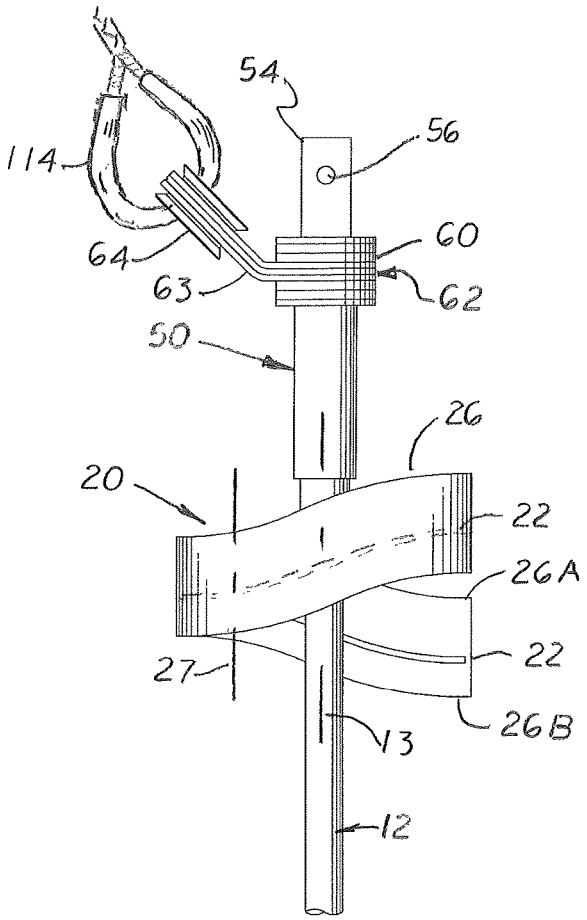
FIG. 2 is a front elevational view of the anchor shown in FIG. 1.
Figure 2:
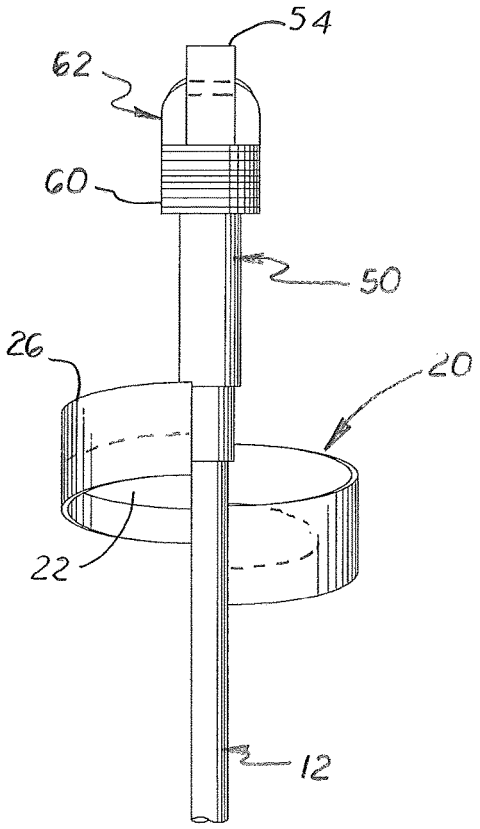
Figure 2:
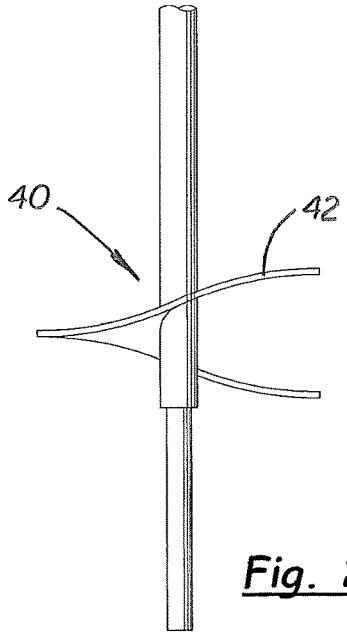
Figure 3:
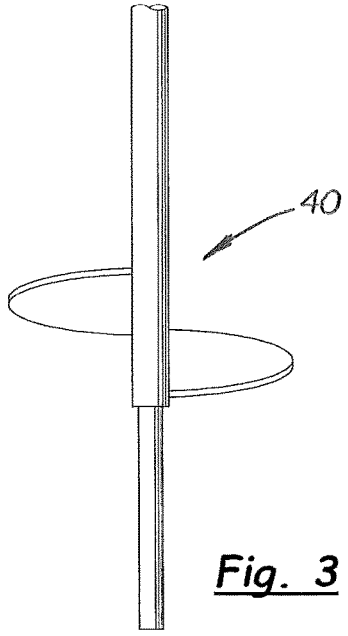
FIG. 3 is a right side elevational view of the anchor shown in FIG. 1.
Figure 5:
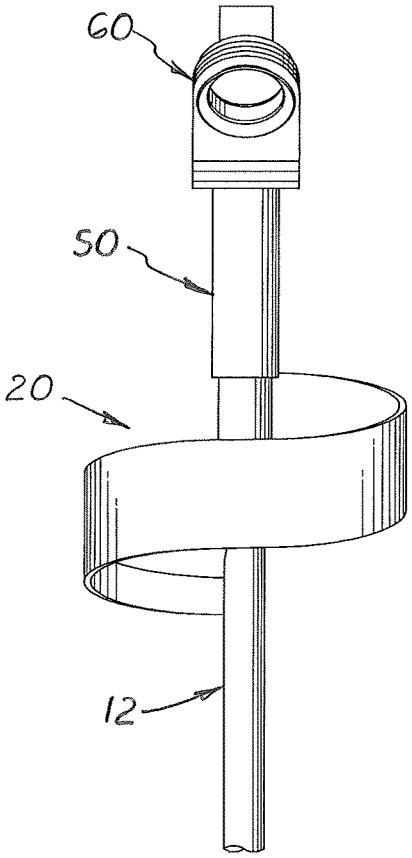
FIG. 5 is a top plan view of the anchor shown in FIGS. 1-4.
Figure 5:
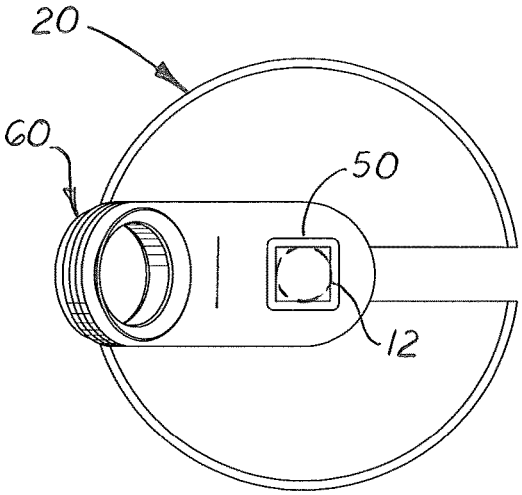
Figure 4:
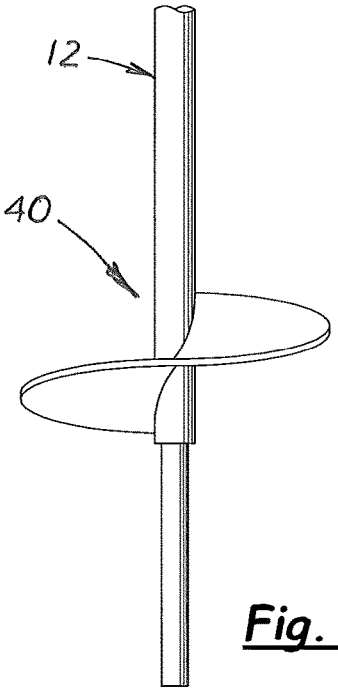
FIG. 4 is a left side elevational view of the anchor shown in FIG. 1.
Figure 6:
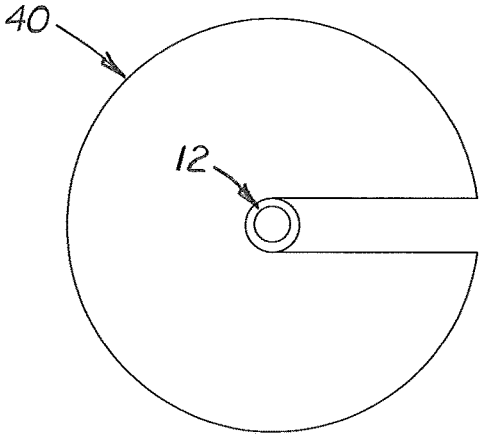
FIG. 6 is a bottom plan view of the anchor shown in FIGS. 1-5.
Figure 7:
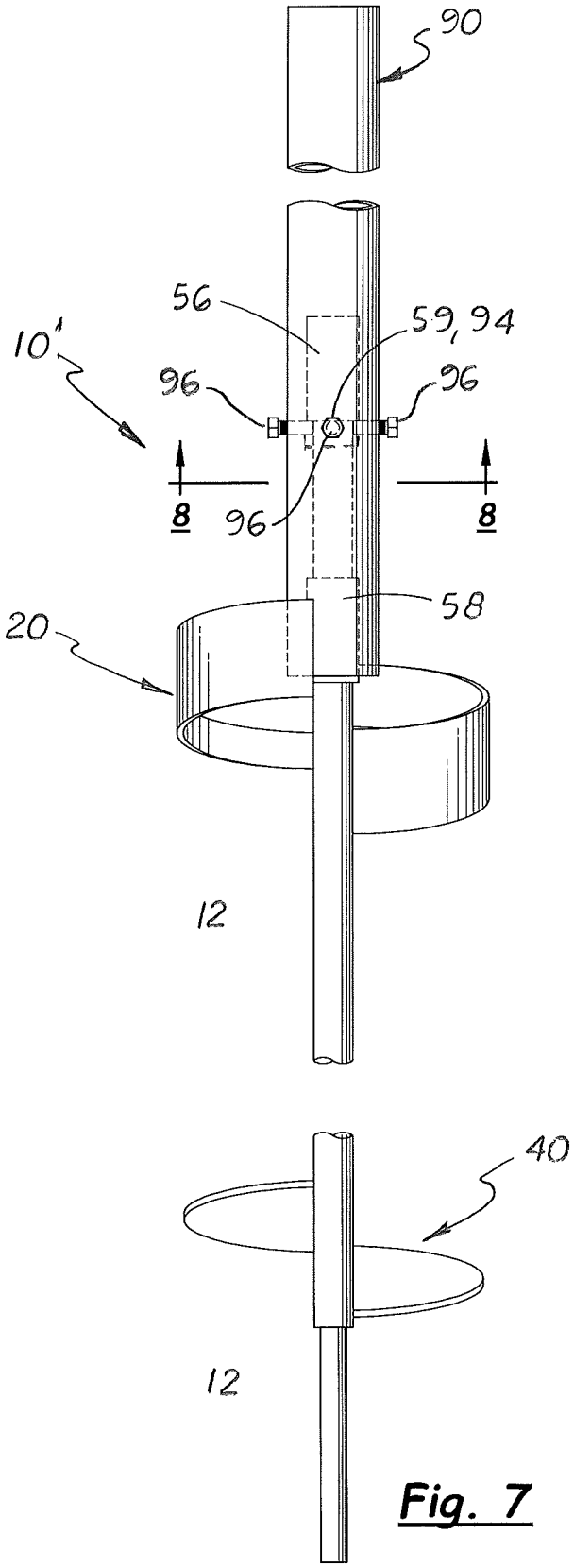
FIG. 7 illustrates a second embodiment of the anchor used with a piling.
Figure 8:
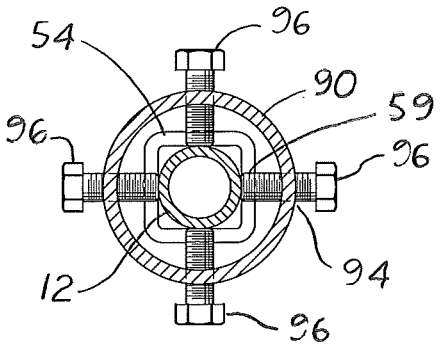
FIG. 8 is a sectional view taken along line 8-8 in FIG. 7.

Attached or formed near or on the outer edge of the curved flange 22 is a vertical wall 26. The vertical wall 26 may be continuous structure that follows part of or the entire outer edge of the curved flange 22. As shown in FIG. 2, the transverse axis 27 of the vertical wall 26 is substantially parallel to the longitudinal axis 13 of the elongated rod 12. In the embodiment shown in the Figs., the vertical wall 26 is 4 inches in width so the top and bottom edges 26A, 26B of the vertical wall 26 do not overlap or connect. Such a structure is similar to a helical staircase. It should be understood that the vertical wall 26 may comprise a plurality shorter, separated vertical wall sections spaced apart along the outer edge of the curved flange 22.

In the embodiments shown, the anchor 10, 10' may include at least one lower helical member 40 attached to the elongated rod 12. The lower helical member 40 may include only a curved flange 42 (as shown). In some applications, the lower helical member 40 may include a continuous or intermittent vertical wall 46 similar to vertical wall 26 used with the upper helical member 20. In the embodiment in the Figs. the outer edge of the curved flange 22 is approximately 12 inches in diameter. The distance between the upper points of the curved flange 42 to the lower points of the curved flange 22 is approximately 6 inches. It should be understood that the curved flange 42 may follow an arc less or over 360 degrees.

The upper and lower helical members 20, 40, respectfully, are spaced apart at least 18 to 48 inches apart so the soil between them is continuous and minimally disrupted.

In anchor 10 when used to restrain a floating buoy 110 or a dock (not shown), the neck 50 formed on the upper end of the elongated rod 12 includes a keyed coupler 54 configured to engage a torque generating tool (not shown) with a compatible surface that rotatably drives the anchor 10 into the subsea floor 200 until the upper helical member 20 is embedded. Mounted on the neck 50 is a rotating joint 60 that holds the swivel arm 62 on the neck 50. The rotating joint 60 includes a circular collar 61 with a center bore that fits around the elongated rod 12. The collar 61 is configured to rotate freely in a 360 arc around the elongated rod 12. The swivel arm 62 is attached to the collar 61 and includes a diagonal plate 63 with a large diameter eyelet 64 configured to receive a lower loop 114 formed on the lower end of the line 112. As shown in FIG. 1, during assembly, an upper loop 113 is formed on the upper end of the line 112. The line 112 is then extended longitudinally through a floating buoy 110. The line 112 exits the floating buoy 110 extends through a short PVC tube 116 and extends through a counterweight 120 configured to hold the floating buoy 110 in an upright orientation in the water. The line 112 then extends through a long PVC tube 124 from the counterweight 120 to a mid-line float 130. The line 112 then extends through the mid-line float 130. The line 112 exits the bottom surface of the mid-line float 130. Formed on the end of the line 112 is a lower loop 114 that engages the eyelet 64 on the diagonal plate 63 as shown in FIG. 2.

In another embodiment, the anchor 10' is used with pilings 90 to securely attach the end of the piling 90 to the unconsolidated subsea floor 200. In anchor 10', the rotating joint 60 and swivel arm 62 are removed and two couplers 56, 58 are formed or attached to the neck 50. Formed on one or both couplers are two or four threaded bores 59. The couplers 54, 58 are configured slide tightly into the open end of a piling 90. During assembly, the piling 90 is longitudinally aligned over the neck 50. Formed on the piling 90 are two to four threaded bores 94 aligned and registered with bores 59 formed on the coupler 56. When the end of the piling 90 is properly positioned over the neck 50, the bores 59, 94 are aligned and threaded connectors 96 are then inserted into the bores 59, 94 to connect the piling 90 to the anchor 10.

The elongated rod 12, the upper and lower helical members 20, 40 and the swivel arm 62 are made of stainless steel or galvanized steel.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

We claim:

1. An improved unconsolidated ground anchor, comprising:
   a. an elongated rod with an upper neck and an opposite lower end;
   b. an upper helical member attached to the elongated rod near the upper end, the upper helical member includes a lateral extending spiral-shaped, curved flange that extends outward around the elongated rod in an arc of at least 120 degrees, the curved flange includes a continuous vertical wall attached to an outer edge of the curved flange that extends upward and downward on opposite sides of the curved flange and configured to resist lateral movement of the anchor when embedded in unconsolidated ground;
   c. at least one lower helical member attached to the elongated rod and below the upper helical member, the lower helical member includes a lateral extending spiral-shaped, curved flange that extends outward around the elongated rod in an arc of at least 120 degrees; and
   d. a coupler attached to the upper end of the elongated rod configured to attach to a rotating tool used to rotate the elongated rod into the unconsolidated ground.

2. The anchor, as recited in claim 1, further including a rotating joint attached to the upper neck and below the coupler, the rotating joint includes a diagonally aligned swivel arm.

3. The anchor, as recited in claim 1, wherein the coupler configured to slide into the upper end of the elongated rod and includes a plurality of threaded connectors that attach the coupler to the upper end of the elongated rod.

4. The anchor, as recited in claim 1, wherein the upper helical member is between 6 to 36 inches in diameter.

5. The anchor, as recited in claim 1, wherein said fixed, lateral spiral-shaped, curved flange that extends outward around the elongated rod in an approximately 360 degree arc.

6. The anchor, as recited in claim 1, wherein the vertical wall is approximately 4 inches wide.

7. The anchor, as recited in claim 1, wherein the lower helical member includes a continuous vertical wall, attached to the curved flange, the vertical wall extends upward and downward on opposite sides of the curved flange and configured to resist lateral movement of the anchor when embedded in the unconsolidated ground.

8. The anchor, as recited in claim 1, wherein the upper helical member and the lower helical member are 18 inches apart.

9. An improved unconsolidated ground anchor, comprising:

a. an elongated rod with an upper neck and an opposite lower end;

b. an upper helical member attached to the elongated rod near the upper end, the upper helical member includes a fixed, lateral spiral-shaped, curved flange that extends outward around the rod in an arc of at least 120 degrees, the curved flange includes a continuous vertical wall, the vertical wall extends on opposite sides of the curved flange forming an upper wall section and a lower wall section on opposite sides of the curved flange, the wall section configured to resist lateral movement of the anchor when embedded in the unconsolidated ground; and c. a rotating joint attached to the upper neck, the rotating joint includes a swivel arm configured to attached to a line attached at one end to a floating buoy or dock.

10. The ground anchor as recited in claim 9, further including a lower helical member attached to the elongated rod and below the upper helical member, the lower helical member includes a lateral extending spiral-shaped, curved flange that extends outward around the elongated rod in an arc of at least 120 degrees.

11. The anchor, as recited in claim 9, wherein the upper helical member is between 6 to 36 inches in diameter.

12. The anchor, as recited in claim 9 wherein the curved flange on the upper helical member extends outward from the elongated rod in an approximately 360 degree arc.

13. The anchor, as recited in claim 9, wherein the vertical wall is approximately 4 inches wide.

14. The anchor, as recited in claim 10, wherein the upper helical member and the lower helical member are 18 inches apart.

15. The anchor, as recited in claim 10, wherein the curved flange on the lower helical member includes a vertical wall that extends upward and downward on opposite sides of the curved flange.

* * * * *